US010961701B2

(12) United States Patent
Rey Farias

(10) Patent No.: US 10,961,701 B2
(45) Date of Patent: Mar. 30, 2021

(54) INTERLOCKING CONSTRUCTION BLOCK

(71) Applicants: Eduardo Alberto Grundland Farace, Montevideo (UY); Fernando Rey Farias, Montevideo (UY)

(72) Inventor: Fernando Rey Farias, Montevideo (UY)

( * ) Notice: Subject to any disclaimer, the term of this patent is extended or adjusted under 35 U.S.C. 154(b) by 0 days.

(21) Appl. No.: 16/607,576

(22) PCT Filed: Apr. 26, 2018

(86) PCT No.: PCT/EP2018/060807
§ 371 (c)(1),
(2) Date: Oct. 23, 2019

(87) PCT Pub. No.: WO2018/197647
PCT Pub. Date: Nov. 1, 2018

(65) Prior Publication Data

US 2020/0048898 A1 Feb. 13, 2020

(30) Foreign Application Priority Data

Apr. 28, 2017 (UY) ..... 37212

(51) Int. Cl.

| | |
|---|---|
| ***E04B 2/18*** | (2006.01) |
| ***E04B 2/26*** | (2006.01) |
| ***E04B 2/40*** | (2006.01) |
| ***E04B 2/30*** | (2006.01) |
| *E04B 2/02* | (2006.01) |
| *E04C 1/39* | (2006.01) |

(52) U.S. Cl.
CPC ..... *E04B 2/18* (2013.01); *E04B 2/26* (2013.01); *E04B 2/30* (2013.01); *E04B 2/40* (2013.01); *E04B 2002/0206* (2013.01); *E04B 2002/0289* (2013.01); *E04C 1/397* (2013.01)

(58) Field of Classification Search
CPC ..... E04B 2/18; E04B 2/26; E04B 2002/0206; E04B 2002/0289; E04B 2/30; E04B 2/40; E04C 1/397; E04C 1/40
USPC ..... 52/580, 591.1, 591.4, 592.1
See application file for complete search history.

(56) References Cited

U.S. PATENT DOCUMENTS

| | | | | | |
|---|---|---|---|---|---|
| 1,785,499 | A * | 12/1930 | Sayers | E04B 2/42 | 52/505 |
| 2,703,487 | A * | 3/1955 | Ossoinack | E04B 2/30 | 52/592.3 |
| 3,685,244 | A * | 8/1972 | Palmer | E04C 1/40 | 52/591.4 |
| 4,216,635 | A * | 8/1980 | Ratliff | B62D 33/042 | 29/428 |
| 5,862,640 | A * | 1/1999 | Negri | E04B 2/16 | 52/438 |

(Continued)

FOREIGN PATENT DOCUMENTS

| | | | | |
|---|---|---|---|---|
| EP | 2944738 B1 * | 7/2018 | ..... | E04C 1/40 |
| WO | WO-2015084274 A1 * | 6/2015 | ..... | E04B 2/18 |

*Primary Examiner* — Brent W Herring
(74) *Attorney, Agent, or Firm* — Eugenio J. Torres-Oyola; Victor M. Rodriguez-Reyes; Ferraiuoli LLC

(57) ABSTRACT

An interlocking construction block having a predefined finish, suitable for the construction of buildings and featuring elements that allow the passage of pipes, ducts or iron rods inside it, enabling construction to be carried out more efficiently, with the consequent reduction in labor and material requirements.

14 Claims, 11 Drawing Sheets

(56) References Cited

U.S. PATENT DOCUMENTS

| | | | | |
|---|---|---|---|---|
| 6,240,693 | B1 * | 6/2001 | Komasara | B26F 1/3846 52/439 |
| 6,758,020 | B2 * | 7/2004 | Cerrato | E04B 1/703 52/223.7 |
| 9,828,769 | B2 * | 11/2017 | Ariba | E04B 2/20 |
| 10,041,243 | B2 * | 8/2018 | Walker | E04C 3/36 |
| 2002/0043038 | A1 * | 4/2002 | Cerrato | E04C 5/08 52/604 |
| 2008/0245013 | A1 * | 10/2008 | Carlisle | E04B 2/8629 52/436 |
| 2010/0212241 | A1 * | 8/2010 | Holroyd | E04C 2/36 52/309.4 |
| 2015/0059278 | A1 * | 3/2015 | Rainio | E04C 1/395 52/431 |
| 2016/0281357 | A1 * | 9/2016 | Aribas | E04B 2/18 |
| 2017/0268226 | A1 * | 9/2017 | Graniglia | E04C 1/397 |

* cited by examiner

INTERLOCKING CONSTRUCTION BLOCK

FIELD OF THE INVENTION

The present invention refers to the field of construction elements, more specifically the field of block-shaped construction elements.

BACKGROUND OF THE INVENTION

Labor accounts for a large part of the costs of traditional building construction. For example, traditional construction with bricks or blocks attached to pillars and beams requires a significant amount of labor, both for the mounting of materials as well as for the subsequent placement of elements such as internal ducts and pipes.

To reduce costs, various builders have sought to develop construction elements that could be assembled more efficiently. Among such construction elements, blocks have been developed that can be interlocked and that allow for less labor.

Application ES2354091 shows a construction block that comprises a half-round cavity that allows the passage of ducts, pipes and cables, and which also allows cutting out sections to enable the placement of built-in boxes. The block, however, is intended for traditional construction.

Application EP0320745 shows a modular block that can be interlocked with pillars and beams built for such purpose. The block comprises modules that allow pouring the material but does not feature a channel structure for the introduction of ducts or pipes. A similar solution is described in patent U.S. Pat. No. 5,706,620.

The number of different pieces needed to construct the building increases with the presence of pillars and beams, with the consequent logistical complexity at the time of carrying out the construction.

Application WO9428262 shows a block that is an improvement of that shown in application EP0320745. The block has, in addition to modules, a series of circular holes that allow the introduction of ducts and pipes before filling the block. However, this solution also requires the use of pillars and beams, in the same way as shown in applications EP0320745 and U.S. Pat. No. 5,706,620. Therefore, WO9428262 requires, in addition to blocks, a series of joining parts to assemble the structure, especially in the junctions with corners.

The presence of pillars and beams requires that the wall built with these blocks must be erected in situ.

There is then the need for a construction block that allows interlocking without requiring pillar- or beam-like pieces in such a way that the block is self-supported and allows the passage of pipes or ducts within it.

SUMMARY OF THE INVENTION

The object of the invention is an interlocking construction block that allows the construction of buildings and which features elements that allow the passage of pipes, ducts or iron rods.

The block of the invention allows constructions to be carried out more efficiently, thus saving labor and material, with the consequent costs reduction.

BRIEF DESCRIPTION OF THE DRAWINGS

Below is a brief description of the drawings enclosed with the application.

DETAILED DESCRIPTION OF THE INVENTION

Figure 1:
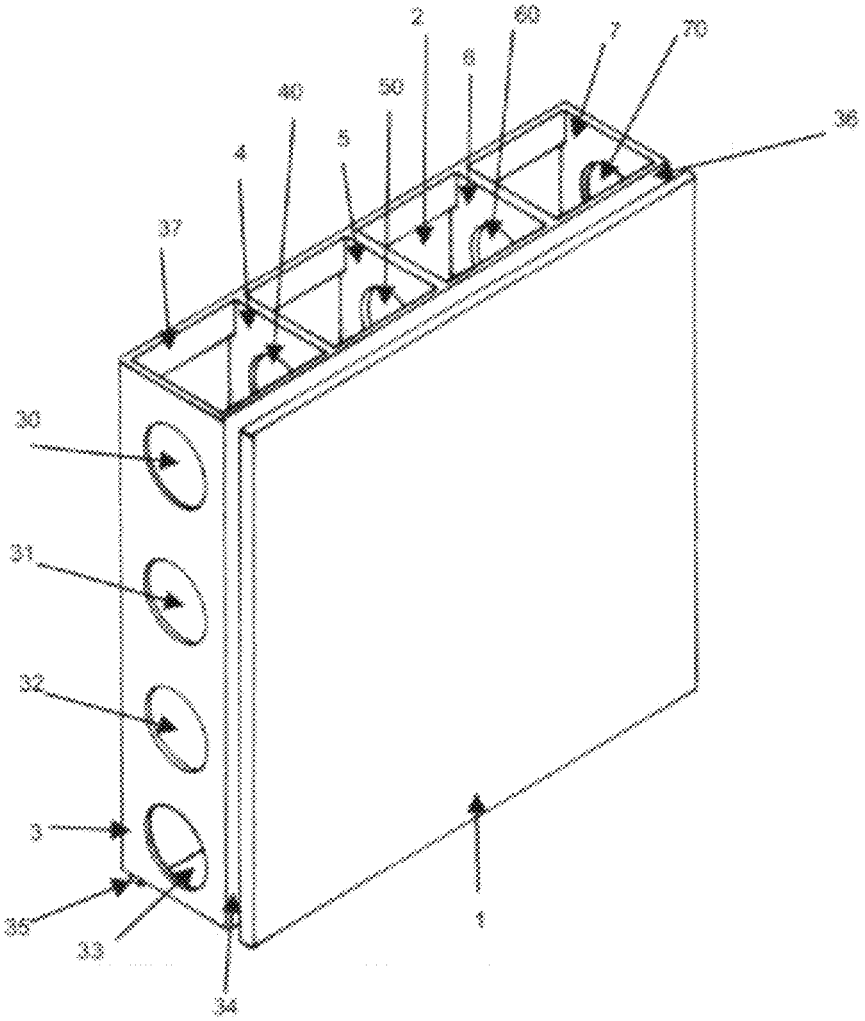
FIG. 1 is a perspective view of a block according to the invention, seen from the front and above.

The object of the present invention is a block characterized in that it comprises:

a—two side panels of rectangular shape and equal dimensions, facing and parallel to each other, b—an outer partition located at 90° of said two side panels, said outer partition having a length equal to the height of the side panels, said outer partition having a width smaller than the distance between the side panels, said outer partition being attached at both longitudinal ends to each of the side panels by means of a first and a second tab, each of said tabs being perpendicular to the outer partition and attached to the inside surface of the edge that constitutes the height of the outer panel, said outer partition being attached to the side panels in such a way that one of its edges extends beyond one of the edges of the side panel, said outer partition having at least one through hole, c—a third tab and a fourth tab projecting from the edge of the outer partition extending beyond the edge of the side panels, perpendicular to said outer partition and not reaching the edge of either lateral panel that is farther from the outer partition, said third and fourth tabs being attached to the inside edge of the side panel, d—one or more inner partitions attached to the inside surfaces of the two side panels and of the third and fourth tabs, each of said inner partitions extending parallel to the outer partition, from the same end as the outer partition and having the same length as said outer partition, each of said inner partitions having at least one through hole, the inner partition that is farthest from the outer partition being attached to the ends of the second and third tabs that are farther away from the outer panel.

The blocks described above can be permanently attached using a suitable binding material. However, in a preferred embodiment, the blocks of the invention may also have grooves and tabs that allow blocks to be interlocked with one another, so as to achieve attachment without the need to use a binding material.

For the blocks to interlock with each other by means of tabs and grooves, the first and second tabs are folded so as to form a first and a second groove, respectively for each tab, extending over all or part of the length of said tabs, while the third and fourth tabs are folded so as to form, respectively for each tab, a third and a fourth groove extending over the length of said tabs. In turn, each side panel will have two pairs of tabs extending perpendicular to the panels, a pair made up of a fifth and a sixth tab located at the opposite end respect of the first and the second groove, respectively, and a pair made up of a seventh and an eighth groove located at the opposite end respect of the third and the fourth groove, respectively, each tab of said two pairs having a width smaller than or equal to the depth of the grooves, the fifth and the sixth tab extending vertically along the side panel, from the upper edge of the side panel over a length equal to or smaller than that of the first and second grooves, respectively, and the seventh and eighth tabs extending along the side panel, from the front edge of the side panel over a length equal to or smaller than that of the third and fourth grooves, respectively.

The height of each side panel is the dimension that runs parallel to the partitions and perpendicular to the third and fourth tabs. The length of each side panel is the dimension running perpendicular to the partitions and perpendicular to the first and second tabs.

The upper edge of each side panel is the edge closer to the third and fourth tabs.

The depth of the groove is the distance between the surface of the side panel and the bottom of the groove.

The number of inner partitions can vary according to the dimensions of the block. For example, for blocks whose dimensions are 50 cm×50 cm×12.5 cm, the use of three inner partitions spaced equally from each other and the outer partition is preferred.

In those preferred embodiments having grooves and tabs for the interlocking of blocks, blocks may have one or more pairs of inner tabs attached to the inside surface of each side panel, each of the inner tabs facing each other and extending parallel to the first pair of tabs. This arrangement allows cutting the block if necessary, so that the internal tabs remain at the end of the block and can be used to interlock the block.

The holes can be of any shape that is considered suitable, although for simplicity reasons a circular shape is preferred.

Some holes may have a certain shape and other holes another shape (for example, some may be circular, and others may be square). However, for simplicity reasons it is preferred for all to have the same shape.

The function of the holes in the partitions is to allow the material that serves as mortar, which is poured through the upper part of the block, to flow easily between the different cavities of the block delimited by the partitions.

The term "material that serves as mortar" is known in construction: it refers to the material used for binding or for filling a building cavity, such as sand and Portland cement, plaster, concrete. The preferred mortar material is concrete.

Any number of holes can be used, but the greater the number of holes and the greater their surface, the more easily the material will flow between the different cavities in the block.

The holes in the different partitions can be aligned horizontally, forming rows of holes, or can be misaligned. However, holes in the partitions aligned horizontally are preferred, because in this way the lines of the different services that are laid horizontally (e.g. water, gas, electricity, air conditioning ducts) can be located inside the blocks, avoiding the need to chop a wall already built in order to place pipes and ducts. The block also allows to install service lines that must run vertically, since these lines can be placed in one or more of the vertical modules of the block.

Holes aligned between partitions also allow to place horizontal iron rods if a structure with a frame is desired, while the partitions in the blocks allow to place iron rods running vertically.

During the manufacture of walls, each block is interlocked with its adjacent blocks. For this operation no guides or special parts are necessary.

The positions of the side panels and the first, second, third and fourth tabs allow to interlock one block with its adjacent block. Such interlock occurs both in the horizontal direction as well as in the vertical direction.

If the block has no grooves or tabs, the attachment of one block to another is achieved by means of a suitable binding material. If the block has grooves and tabs, the fifth and sixth tabs of one block are interlocked with the first and second grooves, respectively, of one of its adjacent blocks, while the seventh and eighth tabs of one block are interlocked with the third and fourth grooves, respectively, of one of its adjacent blocks.

In this way, there is double interlocking of each block with its adjacent blocks and in that way the sealing is improved, with the consequent reduction in waterproofing treatment requirements.

In those areas of the building where the block is exposed, such as window or door openings or corners of the building, blind covers of different materials, such as polyvinyl chloride (PVC), high density polyethylene (HDPE), wood, stainless steel or aluminum, may be used.

A further advantage of the block of the invention is that it may include thermal and/or acoustic insulation, attached to at least one of the inside surfaces of the side panels, in order to reduce the transfer of heat and/or the transmission of sound. Preferably, the blocks that have any of the mentioned insulations will be destined to exterior walls.

Any conventional material suitable for thermal insulation or for acoustic insulation can be used in the block of the invention. Exemplary preferred thermal insulation materials include expanded polystyrene and neoprene. Preferred acoustic insulation materials include polyurethane foam, glass wool or cork.

The thickness of the thermal and acoustic insulators will depend on the insulator chosen and the desired insulation.

As for the filling, it is possible to build the entire wall and then proceed to fill it with material serving as mortar, but it is preferred to build some courses of blocks and then fill them, and then proceed to incorporate new courses of blocks that are filled as the height of the wall increases. In this way, the entire wall can be built with a single type of block (which can be cut into smaller modules if it is too long at a certain point of the wall) without the need for a joining part of any kind. In the case of the block of the invention, blocks can be screwed together at the corners, prior to filling, so as to enhance the attachment without resorting to additional parts.

When the wall is filled with concrete, up to four floors can be built with this system, which does not require beams or pillars for walls.

The fact that each block can be interlocked with its adjacent blocks to form a wall without the need for additional parts allows to prefabricate the wall in a workshop and then assemble it on site. This is especially useful to make advantageous use of rainy days: the wall can be prefabricated indoors and can then be assembled on site when the weather improves, making more advantageous use of available time and thus reducing costs.

The figures, which should be construed as preferred embodiments intended to better illustrate the invention and not to limit the invention in any way, will now be described in detail.

FIG. 1 shows a perspective view of a block of the invention without grooves. The block is made up of two side panels 1, 2, an outer partition 3 and four inner partitions 4, 5, 6, 7.

The outer partition 3 is attached to the side panel 1 by means of the first tab 34 perpendicular to the outer partition, while the second tab cannot be seen in this view because it is on the opposite side respect of the first tab. The outer partition 3 according to this embodiment has four circular holes 30, 31, 32, 33, all of them being through holes.

The third tab 36 and the fourth tab 37 extend from the outer partition 3 along the side panels 1 and 2, respectively, but without reaching the edge of said side panels. The third tab 36 is attached to the inside surface of the edge of the side panel 2, while the fourth tab 37 is attached to the inside edge of the side panel 2.

The block of FIG. 1 also shows four inner partitions 4, 5, 6, 7. The inner partitions are attached to the inside surface of each of the panels 1 and 2 and of each of the tabs 36 and 37. The inner partitions face the outer partition 3, are parallel to said outer partition and have the same length as said outer partition. In the present embodiment, each of the inner partitions has four circular through holes, of which holes 40, 50, 60 and 70 are shown in the present embodiment. The four inner partitions extend from the same end as the outer partition 3. The circular holes are aligned horizontally forming four rows of holes. For example, in the case of the first row, holes 30, 40, 50, 60 are aligned.

In this embodiment the side panels 1, 2 are off-set with respect to the series of partitions, which allows a block to interlock with its adjacent blocks. The interlocking blocks can be attached permanently by means of a suitable binding material.

The height of the side panel 1 is the dimension running parallel to partitions 3, 4, 5, 6, 7 and perpendicular to tab 36. The situation is similar for panel 2.

The length of the side panel 1 is the dimension running perpendicular to partitions 3, 4, 5, 6, 7 and parallel to tab 36. The situation is similar for panel 2.

Figure 2:
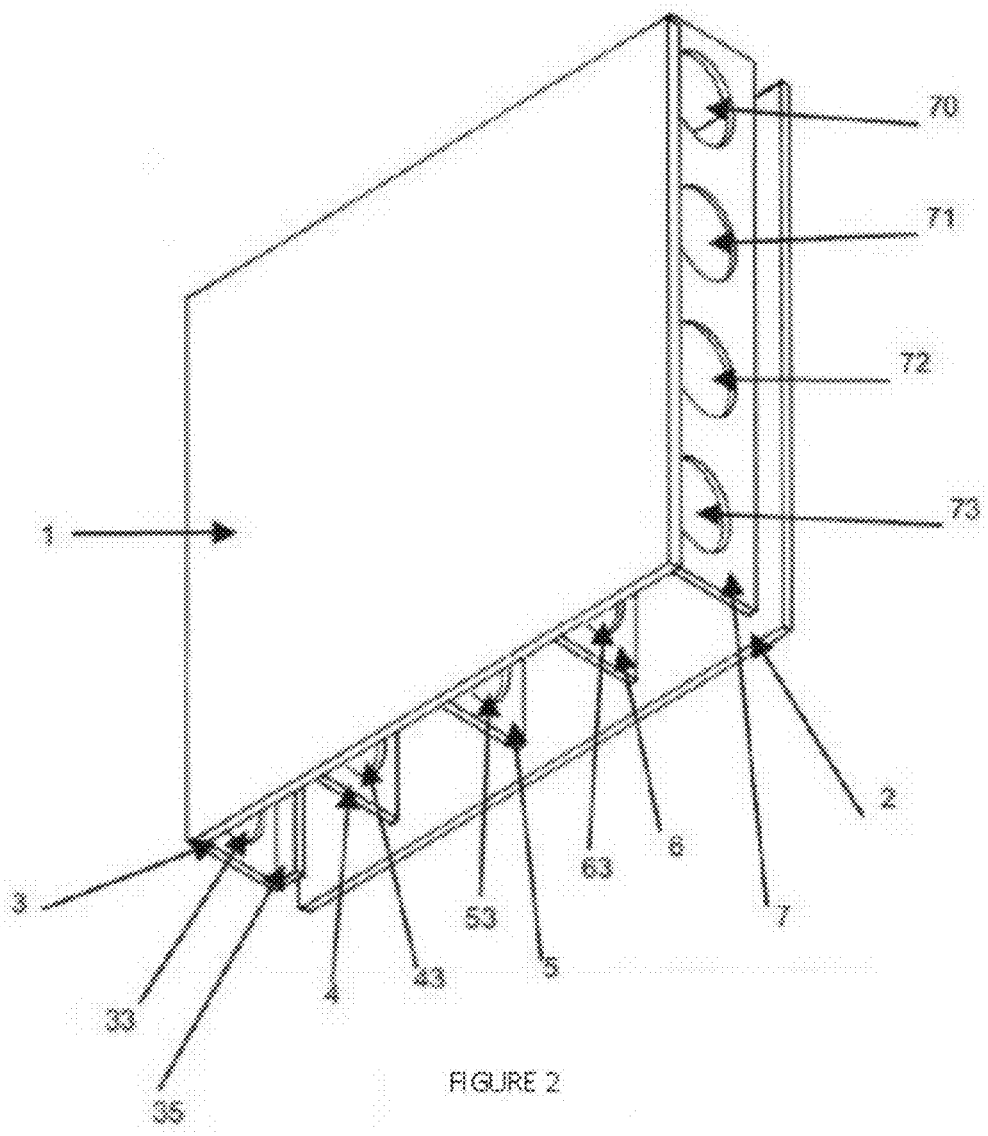
FIG. 2 is a perspective view of the block of FIG. 1, seen from behind and below.

FIG. 2 is another perspective view of the block that provides a view from below and behind. This figure provides a view of the side panels 1 and 2, the outer partition 3 and the inner partitions 4, 5, 6, 7.

This view shows the holes 70, 71, 72, 73 of inner partition 7, as well as the holes 33, 43, 53 and 63 of partitions 3, 4, 5, 6, respectively. In addition, the figure provides a view of the second tab 35 attaching the outer partition 3 to the inside edge of the side panel 2.

Figure 3:
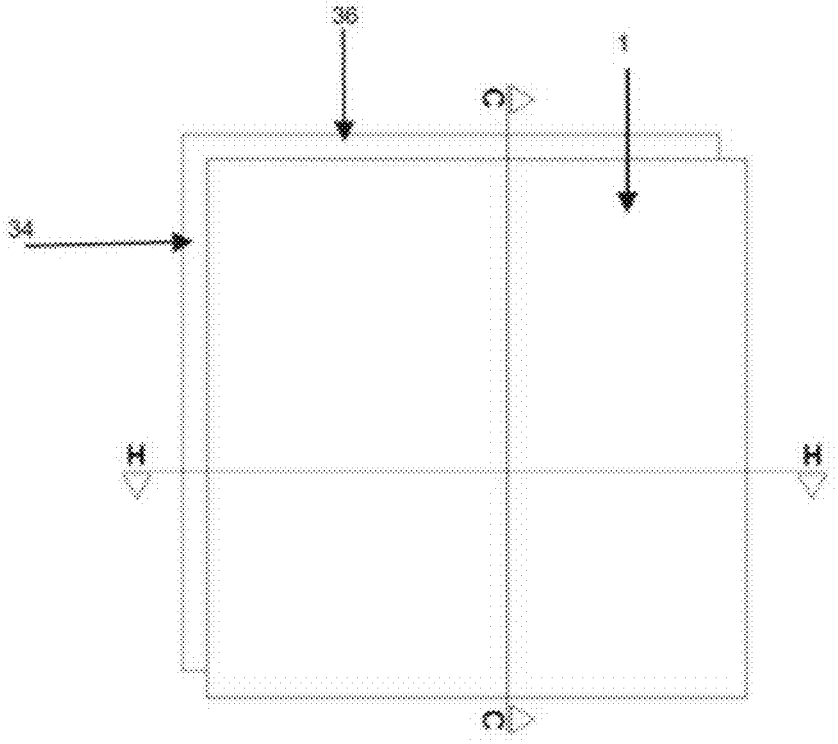
FIG. 3 is a front view of the block of FIGS. 1 and 2.

FIG. 3 is a front view of the block of the invention. The side panel 1 and the tabs 34, 36 are shown in this view. H-H and C-C are section axes that allow to identify the views of FIGS. 4 and 5.

Figure 4:
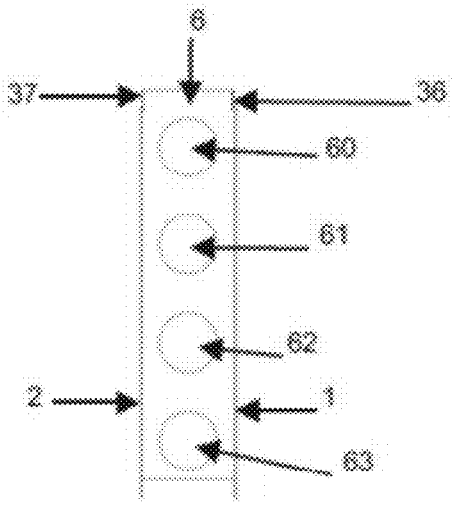
FIG. 4 is a vertical section of the block of FIG. 3.

FIG. 4 is a vertical section of the block of the invention on the C-C plane of FIG. 3. The sectional view shows partition 6, extending widthwise from the inside surface of partition 1 to the inside surface of partition 2 and from the inside surface of tab 36 to the inside surface of tab 37. The sectional view also shows circular through holes 60, 61, 62, 63.

Figure 5:
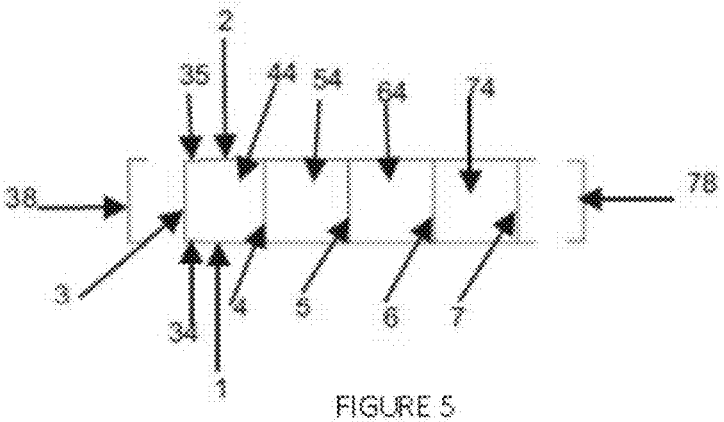
FIG. 5 is a horizontal section of the block of FIG. 3.

FIG. 5 is a horizontal section of the block of the invention on the H-H plane of FIG. 3. The figure shows the division into four vertical modules of the block 44, 54, 64, 74, delimited by the outer partition 3 and the four inner partitions 4, 5, 6, 7. Also shown are the male blind cover 38 and the female blind cover 78, both optionally provided with the block.

Figure 6:
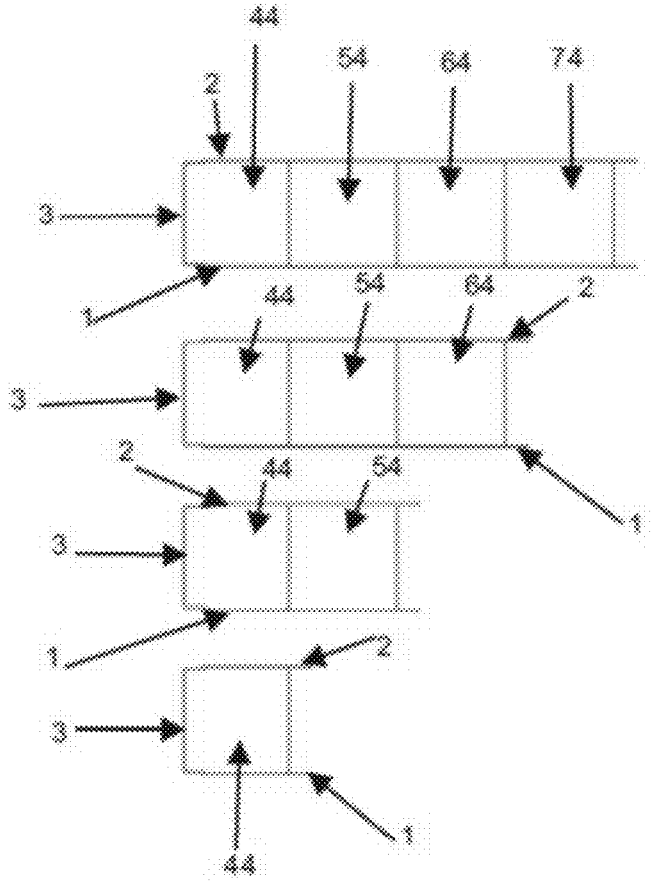
FIG. 6 is an example of cutting off modules from the block of FIG. 3.

FIG. 6 is a top view of the block of the invention with four modules 44, 54, 64, 74 and three examples of blocks with a lower number of modules ("submodulation"). To obtain a block with a smaller number of modules, simply cut the block in a suitable place. This allows to obtain shorter blocks when the available space does not allow the placement of a complete block (for example, door openings, window openings, corners).

Figure 7:
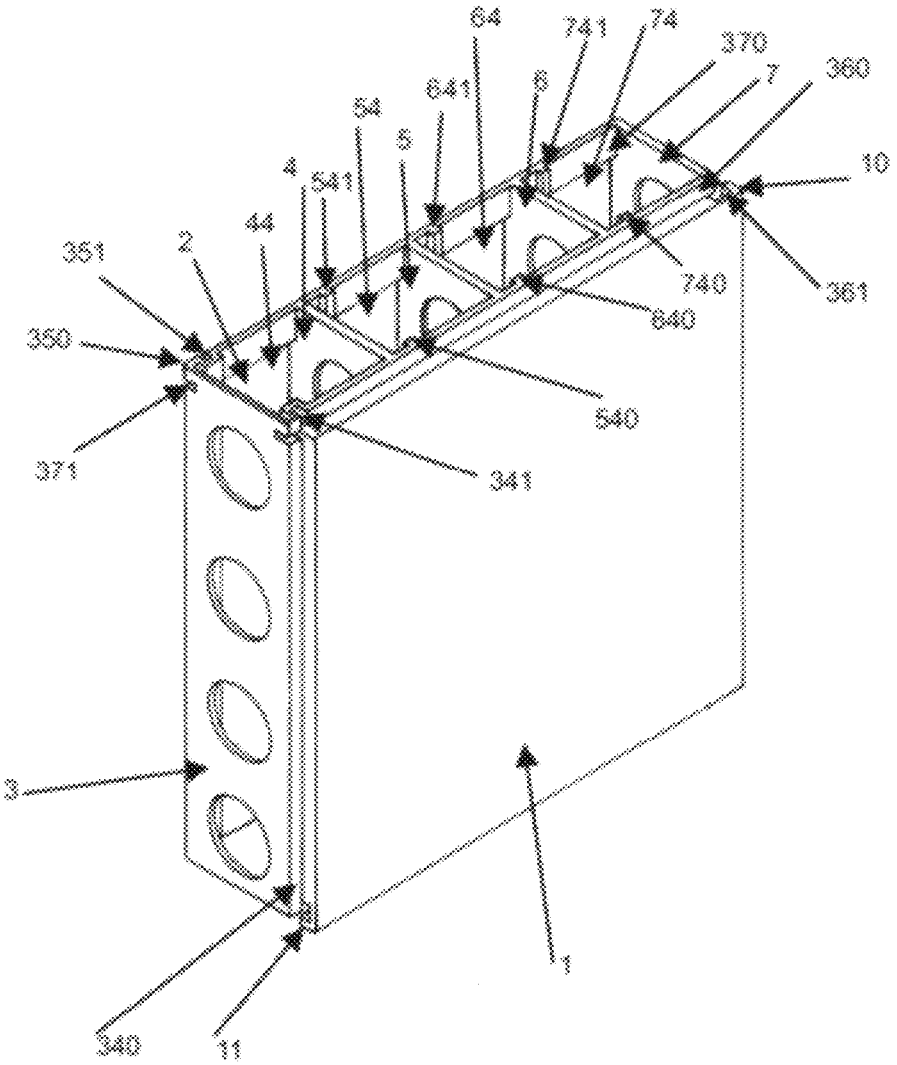
FIG. 7 is a perspective view of another type of block according to the invention, seen from the front and above.

FIG. 7 is an embodiment according to the invention having grooves and tabs for interlocking. The figure shows the block according to the invention with four tabs 340, 350, 360, 370. The first tab 340 and the second tab 350 are folded to form grooves 341 and 351 respectively, while the third tab 360 and the fourth tab 370 are folded to form grooves 361, 371 respectively.

The block has the fifth tab 10 located at the edge of the panel 1 opposite the third tab 340 and having the same length as groove 341; the sixth tab is facing tab 10, at the edge of panel 2, but it cannot be seen in this figure. The fifth and sixth tabs are perpendicular to the edge of the panel to which they are attached and extend to the top of the side panel.

The figure also shows the seventh tab 11, located along the edge of panel 1 opposite the third tab 360 and having the same length as groove 361; the eighth tab is facing tab 11, at the edge of panel 2, but cannot be seen in this figure. The seventh and eighth tabs are perpendicular to the edge of the panel to which they are attached.

The block also has a pair of inner tabs 540, 541 in module 54, a pair of inner tabs 640, 641 in module 64 and a pair of inner tabs 740, 741 in module 74. The function of those inner tabs is to allow the module to be cut immediately behind any of these pairs of tabs, so as to obtain a block with fewer modules.

Figure 8:
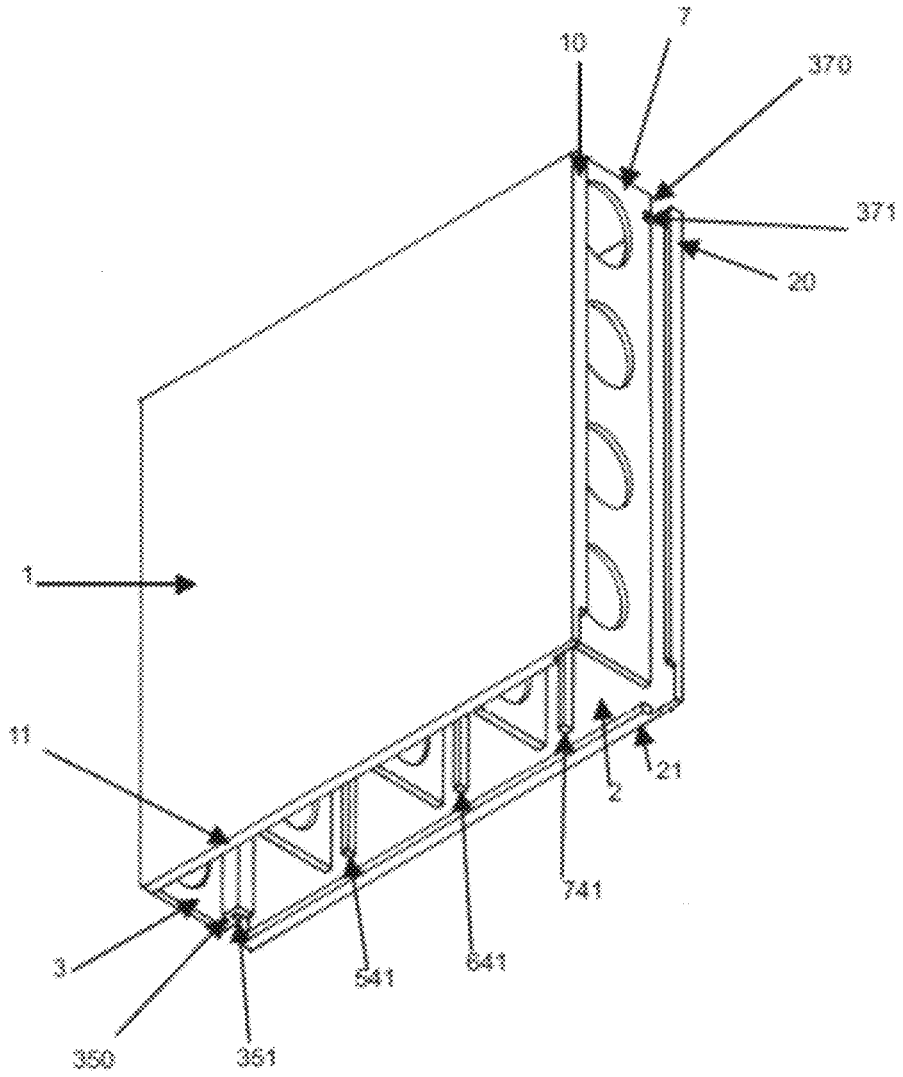
FIG. 8 is a perspective view of the block of FIG. 7, seen from behind and below.

FIG. 8 is another perspective view from below and behind of the block of FIG. 7. This view shows the second tab 350 and its groove 351, the fifth tab 20 and the end of the fourth groove 371.

The arrangement of grooves 341, 351, 361, 371 and of tabs 10, 11, 20, 21 allows each block to interlock with the four adjacent blocks, to obtain a solid structure without the need to bind a block with those adjacent to it.

Figure 9:
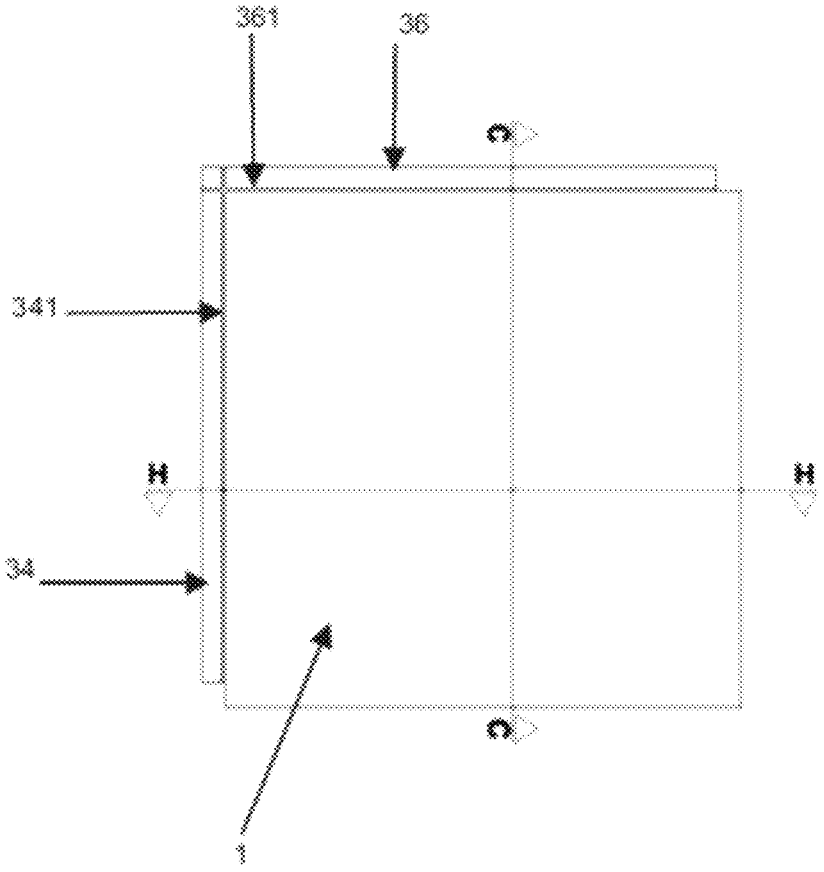
FIG. 9 is a front view of the block of FIGS. 7 and 8.

FIG. 9 is a front view of the block of the invention. The side panel 1, tabs 34 and 36 and grooves 341 and 361 are shown. H-H and C-C are section axes that identify the views of FIGS. 10 and 11.

Figure 10:
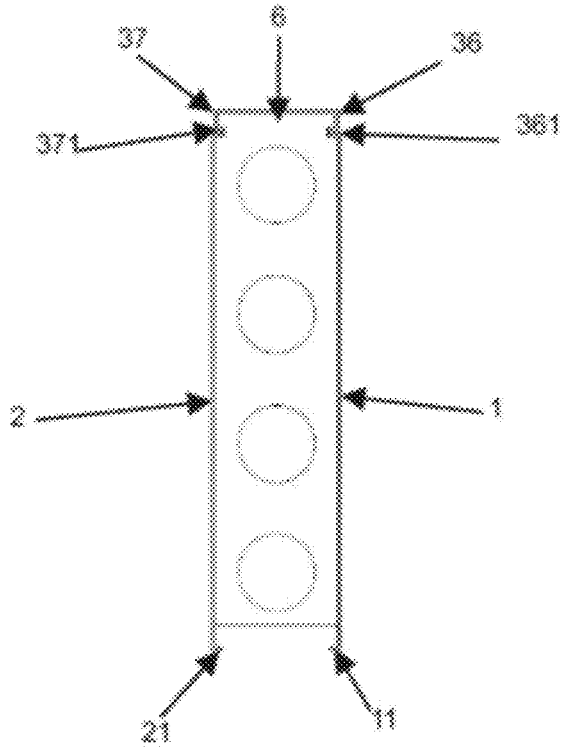
FIG. 10 is a vertical section of the block of FIG. 9.

FIG. 10 is a vertical section of the block of the invention on the C-C plane of FIG. 9. The sectional view shows partition 6, extending widthwise from the inside surface of partition 1 to the inside surface of partition 2 and from the inside surface of tab 36 to the inside surface of tab 37. This view also shows the third groove 361 and the fourth groove 371, as well as the first tab 11 and the second tab 21.

Figure 11:
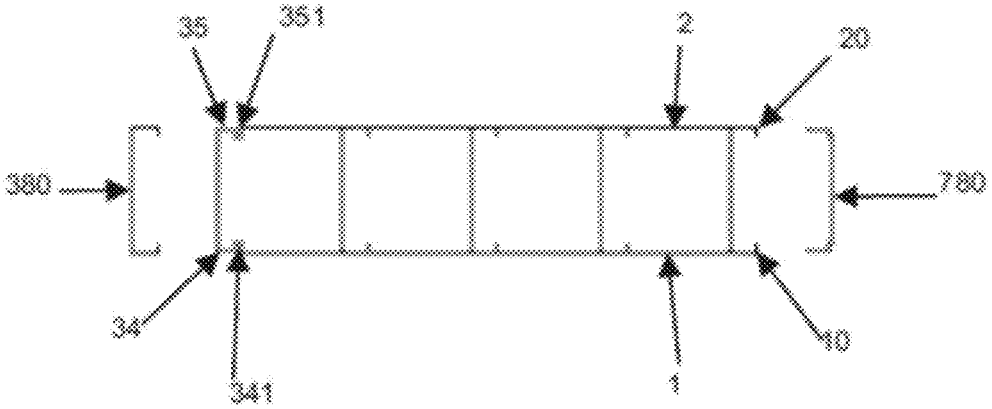
FIG. 11 is a horizontal section of the block of FIG. 9.

FIG. 11 is a horizontal section of the block of the invention on the H-H plane of FIG. 9. The figure shows the first tab 34, the second tab 35, the fifth tab 10 and the sixth tab 20, as well as the first groove 341 and the second groove 351.

The figure also shows two covers: a male blind cover 380 and a female blind cover 780. In this case the covers have tabs allowing to interlock the block, although the tabs are not obligatory. The block covers are optional.

Figure 12:
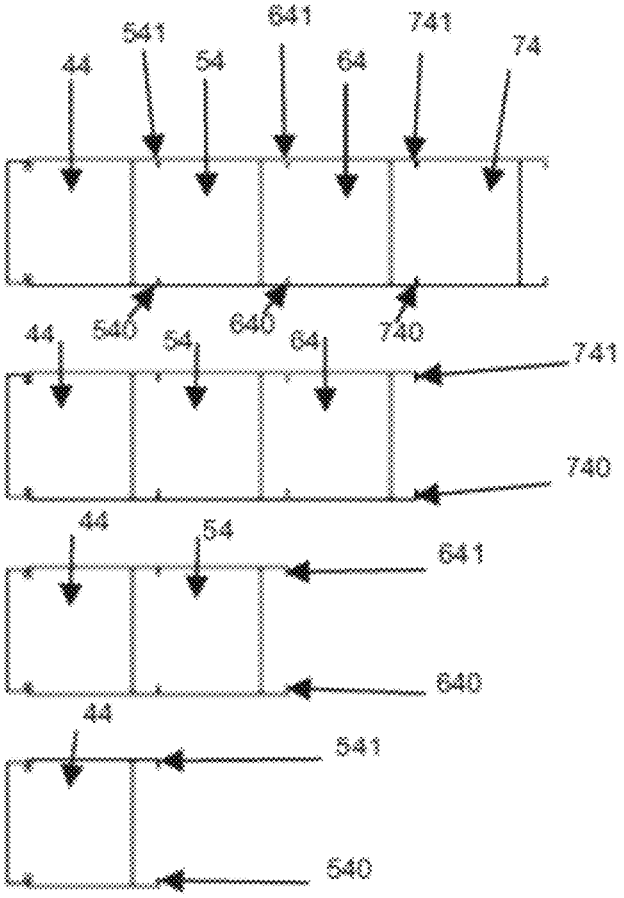
FIG. 12 is an example of cutting off modules from the block of FIG. 9.

FIG. 12 is a top view of the block of the invention with four modules 44, 54, 64, 74 and three examples of blocks with fewer modules. To obtain a block with fewer modules, simply cut the block immediately behind one of the pairs of inner tabs, depending on the number of modules you want. For example, if a block with three modules is desired, the block is cut along the pair of inner tabs 740 and 741; if a block with two modules is desired, the block is cut along the pair of inner tabs 640 and 641; if a block with a module is desired, the block is cut along the pair of inner tabs 540, 541.

This allows to obtain shorter blocks when the available space does not allow the placement of a complete block (for example, door openings, window openings, corners).

Figure 13:
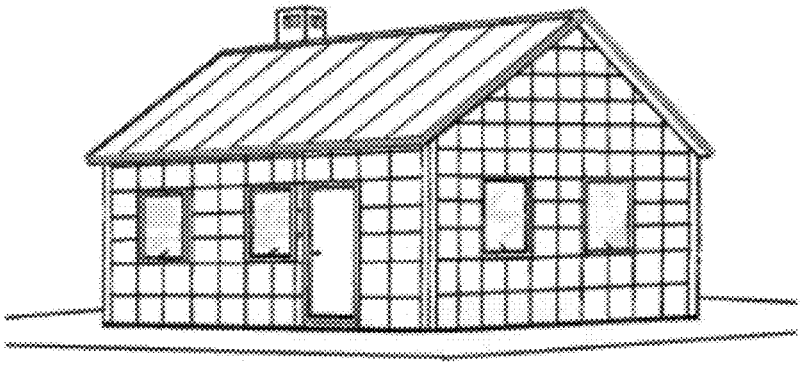
FIG. 13 shows a house built with the blocks of the invention.

FIG. 13 shows a wall design of a house built with the blocks of the invention, located in-bond. The blocks interlock with each other and allow simple and economical wall construction. The construction of the blocks allows you to easily leave the openings to locate elements such as doors and windows.

For the construction of a wall with blocks without tabs such as that of FIGS. 1 and 2, each block is interlocked with its adjacent block and attached [to it] by means of binding material. In this case, each side panel 1 is placed next to another side panel 1 of the adjacent blocks, while each side panel 2 is placed next to another side panel 2 of the adjacent blocks.

However, if a block with protruding tabs is used, the tabs protruding from a block are made to interlock with the grooves of its adjacent blocks. Thus, tabs 11 and 21 of a block are interlocked with grooves 361 and 371 respectively of an adjacent block, while tabs 10 and 20 of a block are engaged in the tabs 341 and 351 respectively of an adjacent block. In this way each block is firmly attached to its adjacent blocks without the need to use binding material as well as adding firmness to the entire structure.

The wall of the figure is built in an in-bond pattern, but could also be built in a staggered pattern, for example half-brick or quarter-brick.

Once the blocks on the wall are aligned, the pipes, ducts or iron rods to be incorporated into the structure are placed and then the structure is filled with the material that will serve as mortar, preferably concrete.

The block of the invention may be constructed of any suitable material, such as for example metallic or polymeric materials. The use of polymeric materials, such as high-density polyethylene (HDPE) or polyvinyl chloride (PVC), is preferred. Especially preferred is PVC.

The advantage of the construction with polymeric materials is that said materials can be easily cut in cases where "submodulation" of the block is desired.

Side panels can be white or any desired color and if it is possible for the material used. In addition, they can be smooth, or they can have printed flat drawings, or they can have texture in relief, like for example a printing having the appearance of slabs/tiles or stone or wood or bricks. In this way, the cost of wall finishing is reduced.

The block can be manufactured by any suitable conventional method. In the case of plastic materials, its manufacture by injection is preferred. The manufacture of blocks as a single piece by injection confers rigidity on the block because the inner partitions act as nerves that prevent deformations when filling the block with material. In this way, the thickness of plastic walls can be reduced, with the consequent decrease in the cost of the block.

Another option, in the case of plastic materials, is the manufacture of two or more pieces that are attached by any suitable means.

Another possible alternative in the case of plastic materials is manufacture by means of 3D printers. This alternative has the advantage that it is possible to manufacture the block without the need for any type of mold.

What is claimed is:

1. A construction block comprising:

two side panels of rectangular shape and of equal dimensions, facing each other and parallel to each other;

an outer partition located at 90° of said two side panels, said outer partition having a length equal to the height of the side panels, said outer partition having a width smaller than the distance between the side panels, ends each of the longitudinal ends of said outer partition being attached to each of the longitudinal ends of said side panels by means of a first tab and a second tab, each of said first and second tabs being perpendicular to the outer partition, each of said first and second tabs attached to an inside surface of the edge that constitutes the height of the outer partition, said outer partition being attached to the side panels so that one of the edges of said outer partition extends beyond one of the edges of the side panel, said outer partition having at least one through hole;

a third tab and a fourth tab projecting from the edge of the outer partition and beyond the edge of the side panels, perpendicular to said outer partition and without reaching the edge of each side panel that is farther from the outer partition, each of said third and fourth tabs respectively attached to an inner edge of one of the side panels;

one or more inner partitions attached to the inside surfaces of the two side panels and of the third and fourth tabs, each of said inner partitions extending parallel to the outer partition, from the same end as the outer partition and having the same length as said outer partition, each of the inner partitions having at least one through hole, the inner partition that is farthest from the outer partition being attached to the end of the second and third tabs that is farther from the outer partition.

2. The construction block of claim 1, wherein:

the first and second tabs are folded so as to form a first and a second groove extending over all or part of the length of said tabs, while the third and fourth tabs are folded so as to form a third and fourth groove extending over the length of said tabs; and each side panel having two pairs of tabs extending perpendicular to the panels, a pair made up of a fifth and a sixth tab located at the opposite end respect of the first and second grooves, respectively, and a pair made up of a seventh and an eighth tab located at the opposite end respect of the third and fourth grooves, respectively, each tab of said two pairs of tabs having a width smaller than or equal to the depth of the grooves, the fifth and sixth tabs extending vertically over the height of the side panel, from the upper edge of the side panel over a length equal to or smaller than that of the first and second grooves, respectively, the seventh and eighth tabs extending horizontally over the length of the side panel, from the front edge of the side panel over a length equal to or smaller than that of the third and fourth grooves, respectively.

3. The construction block according to claim 2, wherein the fifth, sixth, seventh and eighth tabs have a width equal to the depth of the grooves.

4. The construction block according to claim 3, wherein the fifth, sixth, seventh and eighth tabs extend over a length equal to that of the first, second, third and fourth grooves, respectively.

5. The construction block according to claim 4, wherein the holes in the different partitions are circular in section and are aligned horizontally.

6. The construction block according to claim 5, further comprising one or more pairs of inner tabs attached to the inside surface of the side panel, each tab of a pair of tabs facing the other tab of the same pair.

7. The construction block according to claim 6, further comprising thermal and/or acoustic insulation attached to at least one of the inside surfaces of the side panels.

8. The construction block according to claim 7, wherein the thermal insulation is neoprene.

9. The construction block according to claim 6, wherein the side panels have relief texture.

10. The construction block according to claim 5, wherein the side panels have relief texture.

11. The construction block according to claim 1, wherein the holes in the different partitions are circular in section and are aligned horizontally.

12. The construction block according to claim 11, further comprising thermal and/or acoustic insulation attached to at least one of the inside surfaces of the side panels.

13. The construction block according to claim 12, wherein the thermal insulation is neoprene.

14. The construction block according to claim 1, further comprising blind covers at said longitudinal ends.

* * * * *